United States Patent [19]

Takiguchi et al.

[11] 4,421,839

[45] Dec. 20, 1983

[54] HEAT-SENSITIVE AND PHOTOFIXING RECORDING SHEET WITH DIAZOSULFONATE AND ACIDIC COUPLING AGENT THEREFORE

[75] Inventors: Ryohei Takiguchi, Narashino; Masayoshi Nagashima, Chigasaki, both of Japan

[73] Assignees: Dai Nippon Printing Co., Ltd.; Tokyo Shibaura Denki Kabushiki Kaisha, both of Tokyo, Japan

[21] Appl. No.: 354,525

[22] Filed: Mar. 3, 1982

Related U.S. Application Data

[63] Continuation-in-part of Ser. No. 174,443, Aug. 1, 1980, abandoned.

[30] Foreign Application Priority Data

| | | | |
|---|---|---|---|
| Aug. 3, 1979 | [JP] | Japan | 54-107358 |
| Aug. 3, 1979 | [JP] | Japan | 54-107359 |
| Aug. 3, 1979 | [JP] | Japan | 54-107360 |
| Aug. 3, 1979 | [JP] | Japan | 54-107361 |
| Oct. 8, 1979 | [JP] | Japan | 54-128816 |
| Oct. 8, 1979 | [JP] | Japan | 54-128817 |

[51] Int. Cl.[3] ..... G03C 1/56; G03C 1/58

[52] U.S. Cl. ..... 430/164; 430/147; 430/151; 430/155; 430/173; 430/180; 430/181; 430/188; 430/346; 430/348; 430/541; 430/195; 430/287; 430/189; 250/316.1; 250/317.1; 428/913; 346/1.1; 346/76 PH; 346/135.1

[58] Field of Search ..... 430/188, 164, 147, 151, 430/180, 181, 173, 346, 348, 541, 155, 195, 287, 189; 250/316.1, 317.1; 346/1.1, 76 PH, 135.1; 428/913

[56] References Cited

U.S. PATENT DOCUMENTS

| | | | |
|---|---|---|---|
| 2,217,189 | 10/1940 | Sus | 430/188 |
| 2,937,085 | 5/1960 | Seven et al. | 430/160 |
| 3,149,972 | 9/1964 | Herrick et al. | 430/188 |
| 3,312,551 | 4/1967 | Sus | 430/188 |
| 3,479,183 | 11/1969 | Habib et al. | 430/188 |
| 3,637,375 | 1/1972 | Levinos | 430/188 |
| 3,695,885 | 10/1972 | Maryama et al. | 430/151 |
| 3,740,229 | 6/1973 | Maruyama et al. | 430/151 |
| 3,856,528 | 12/1974 | Levinos | 430/188 |
| 3,862,860 | 1/1975 | Pardee et al. | 430/140 |
| 3,999,992 | 12/1976 | Van Paesschen et al. | 430/140 |

FOREIGN PATENT DOCUMENTS

| | | | |
|---|---|---|---|
| 51-31233 | 3/1976 | Japan | 430/188 |
| 51-46946 | 4/1976 | Japan | 430/188 |
| 51-108843 | 9/1976 | Japan | 430/188 |
| 51-108844 | 9/1976 | Japan | 430/188 |
| 56-5790 | 1/1981 | Japan . | |
| 56-5792 | 1/1981 | Japan . | |

OTHER PUBLICATIONS

Chemical Abstracts, vol. 95:33439q, 1981 (Abstract of Jap. Kokai-81 05,790 ).

Chemical Abstracts, vol. 95:52660w, 1981 (Abstract of Jap. Kokai-81 05,792).

*Primary Examiner*—Charles L. Bowers, Jr.

*Attorney, Agent, or Firm*—Cushman, Darby & Cushman

[57] ABSTRACT

A heat-sensitive recording sheet is proposed which has a heat-sensitive recording layer laminated on one surface of a support body and containing a diasosulfonate; a acid coupling agent comprising a compound having aromatic ring, hetroaromatic ring or substituted aromatic ring bonded thereto OH group and COOH group; and a thermoplastic resin having a glass transition point of 70°-150° C. or a photocuring resin.

6 Claims, No Drawings

HEAT-SENSITIVE AND PHOTOFIXING RECORDING SHEET WITH DIAZOSULFONATE AND ACIDIC COUPLING AGENT THEREFORE

CROSS-REFERENCE TO THE RELATED APPLICATION

This application is a continuation-in-part application of the U.S. patent application Ser. No. 174,443 filed on Aug. 1, 1980 now abandoned.

BACKGROUND OF THE INVENTION

The present invention relates to a heat-sensitive recording sheet for heat-sensitive recording using a thermal head.

Various non-impact type recording devices have been recently proposed. The demand for heat-sensitive recording devices as output devices for equipment such as information processors has increased since labor for maintenance or the like can be reduced to a minimum, no noise or other pollution is generated, and the construction of a heat-sensitive recording device is easy. For example, in a ticketing machine, this type of heat-sensitive recording device is used as a printing means for the tickets. However, since it is necessary to prevent alteration of tickets after issuing them and to secure the durability of the printing (especially in the case of a commutation ticket) for withstanding use over an extended period of time, a method has been desired which is capable of fixing the image after the heat-sensitive recording.

The thermally developing diazo-compound method is one example of a recording method which is capable of photofixing the recorded image. This method, however, is defective in durability. Among the thermally developing diazo-compound methods, the method which uses a recording material including a diazosulfonate offers the best advantages for heat-sensitive recording and photofixing due to the relative stability of the recording material in a dark environment.

Many studies have been made about the reaction of diasosulfonates to heat and light, and their optical behavior may be shown as follows:

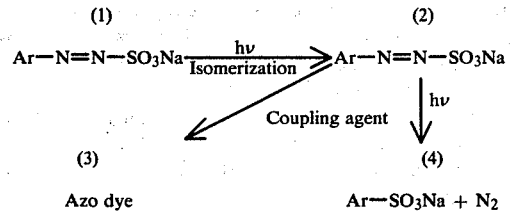

As a recording method utilizing these characteristics, techniques are disclosed in the U.S. Pat. No. 2,217,189 for decomposing the diazosulfonate in the exposed part by the reaction (1)→(2)→(4) for pattern exposure or obtaining an image by the reaction (1)→(2)→(3) for color formation of the unexposed part by heating. Further, in the Japanese patent publication No. 51-43926, a method for producing the reaction (1)→(2)→(3) by simultaneously supplying light and heat is disclosed.

However, since a thermal head is generally used in heat-sensitive recording, and since there is a limit to the heat energy represented by the product of the temperature and time due to the service life of the thermal head, the above-mentioned methods cannot be utilized. In the method disclosed in the U.S. Pat. No. 2,217,189, the heat-sensitivity is low and the image density is low. In the method disclosed in the Japanese patent publication No. 51-43926, the fixing reaction (1)→(2)→(4) requires a large amount of exposure light and thus cannot be realized in ticketing machines.

SUMMARY OF THE INVENTION

The present invention has been made to overcome these problems of the prior art and has for one of its objects to provide a heat-sensitive recording printing sheet in which the durability of the recorded information is excellent and alteration of information is prevented.

In order to achieve this object, there is provided according to the present invention a heat-sensitive recording sheet wherein on at least one major surface of a sheet-like support body is formed a heat-sensitive recording layer consisting of a diazosulfonate; an acidic coupling agent comprising an aromatic compound in which one or more —OH groups and one —COOH group are bonded to an aromatic ring, a heteroaromatic ring or a substituted aromatic ring; and a member selected from the group consisting of thermosetting or thermoplastic resins having a glass transistion point of 70°-150° C.

DETAILED DESCRIPTION OF THE PREFERRED EMBODIMENTS

The heat-sensitive recording sheet of the present invention will be used only for fixing a heat-sensitive recording as described below.

First, light is irradiated on a heat-sensitive layer deposited on one major surface of a supporting sheet containing a diazosulfonate, a coupling agent, and a binder so as to change the diazosulfonate unstable as represented by (2) and to effect an optical activation for improving the heat-sensitivity and photosensitivity; performing heat-sensitive recording on the activated heat-sensitive layer with a small amount of energy; and photofixing this with a relatively small exposure to light.

Since the heat-sensitive recording sheet is manufactured through the steps of optical activation, thermal printing, and photofixing, the coupling agent to be used herein is required to satisfy the conditions below:

(1) The coupling reaction is difficult to progress during the step of optical activation.

(2) The decomposition of the diazosulfonate is facilitated during the step of photofixing.

For this reason, an acidic coupling agent is used according to the present invention wherein one or more —OH groups and one —COOH group are bonded to an aromatic group a heteroaromatic group or a substituted aromatic group. When the —COOH group which is an electron attractive group is bonded to an aromatic group which has a phenol —OH group, the density of the electrons of the carbon atoms in the aromatic ring is decreased. Especially, it is considered that the density of electrons is decreased at carbons to which the diazosulfonate is bonded. Thus, diazonium cations tend not to react, so that the coupling speed is decreased. Furthermore, due to the presence of the —COOH group as an acidic group, the pH in the heat-sensitive layer decreases, so that the decomposition of the diazosulfonate is facilitatated without imparing the reactivity of the coupling agent. Although it may be proposed to add other types of organic acids in order to decrease the pH of the heat-sensitive layer, the addition of such an organic acid significantly impairs the coupling reaction and results in a decrease in the coloration density.

Groups which are electron attractive groups and also acidic groups include the —$SO_3H$ group in addition to the —COOH group. However, the —$SO_3H$ group is strongly acidic and is insoluble in the organic solvent. Since the pH of the heat-sensitive layer is not decreased unless in a soluble system, the coupling agent which has an —$SO_3H$ group is not preferable for the purpose of the present invention.

Preferable examples of the acidic coupling agent to be used in the present invention include:

(i) couplers which have one —OH group and one —COOH group bonded to an aromatic ring or a heteroaromatic ring (e.g., a benzene ring, a naphthalene ring, a carbazole ring, a dibenzofuran ring, and an anthracene ring): 2-hydroxybenzoic acid, 3-hydroxybenzoic acid, 4-hydroxybenzoic acid, 2-hydroxy-3-naphthoic acid, 2-hydroxy-1-naphthoic acid, 1-hydroxy-2-naphthoic acid, 2-hydroxy-6-naphthoic acid, 2-hydroxycarbazole-3-carboxylic acid, 2-hydroxydibenzofuran-3-carboxylic acid, and 3-hydroxyanthracene-2-carboxylic acid;

(ii) couplers which have one —OH group and one —COOH group bonded to a substituted aromatic ring (e.g., substituted by an alkyl group, an alkoxy group, a halogen group, an amino group, and an acetoacetoamino group): 4-aminosalicylic acid and acetoacetoaminosalicylic and;

(iii) couplers which have two or more —OH groups and one —COOH group bonded to an aromatic ring: 2,6-dihydroxybenzoic acid, 2,5-dihydroxybenzoic acid, 3,5-dihydroxybenzoic acid, 3,4-dihydroxybenzoic acid, 2,3-dihydroxybenzoic acid, 2,4-dihydroxybenzoic acid, and 2,4,6-trihydroxybenzoic acid; and (iv) couplers which have two or more —OH groups and one —COOH group bonded to a substituted aromatic ring (e.g., substituted by an alkyl group, an alkoxy group, a halogen group, and an amino group): 4-bromo-3,5-dihydroxybenzoic acid.

The acidic coupling agent as described above which is used for thermal printing in the steps of optical activation, thermal printing and photofixing has advantages over other coupling agents in that (i) durability is improved; (ii) the quantity of heat required for obtaining high printing density remains unchanged; (iii) fixability is improved; and (iv) the image quality is improved i.e. no fog is developed and contrast is improved.

If the acidic coupling agent as described above does not provide sufficiently wide ranges for selection of the hue and density of coloration and the coupling speed, other coupling agents may also be used in combination. The amount of the additional coupling agent which is to be used with the acidic coupling agent described above is selected depending upon the coupling speed of the acidic coupling agent and the like. However, in general, 0.1 to 10 parts by weight of the acidic coupling agent and 0.01 to 5 parts by weight of the additional coupling agent may be added, based on 1 part by weight of the diazosulfonate.

Diazosulfonates that can be used for the recording layer of the present invention are compounds expressed by the following general formula:

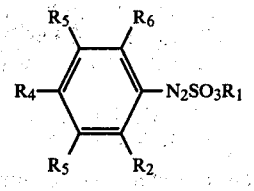

where $R_1$ stands for an alkali metal; $R_2$, $R_3$, $R_5$ and $R_6$ each stand for hydrogen, a halogen, or an alkyl or alkoxy group; $R_4$ stands for hydrogen, a halogen, alkyl, amino, benzoylamino, morpholino, tolylmercapto or pyrrolidino group. Various of these diazosulfonates are known and are obtainable by treating respective corresponding diazonium salts with a metal nitrite. Particularly suitable are compounds wherein $R_4$ is an amino, benzoylamino, morpholino, tolylmercapto or pyrrolidino group; $R_2$ and $R_5$ are each hydrogen; and $R_3$ and $R_6$ are each a methoxy, ethoxy or butoxy group. These are the diazosulfonates obtained from diazonium salts conventionally used in wet diazocopy. Such compounds include:

Sodium benzenediazosulfonates having such substituting groups as 2-methoxy; 2-phenoxy; 2-methoxy-4-phenoxy; 2,4-dimethoxy; 2-methyl-4-methoxy; 2,4-dimethyl; 2,4,6-trimethyl; 2,4,6-trimethoxy; 2,4-dimethoxy-5-chloro; 2-methoxy-5-nitro; 2-methoxy-5-acetoamido; 2-methoxy-5-N,N-diethyl-sulfonamido; 2-methoxy-5-N-phenylcarbamyl; 3-methyl; 5-methyl; 4-methoxy; 4-ethoxy; 4-phenyl; 4-phenoxy; or 4-acetoamido;

or sodium benzenediazosulfonates having substituting groups such as 4-(N-ethyl,N-benzylamino); 4-(N,N-dimethylamino); 4-(N,N-diethylamino); 4-(N,N-diethylamino)-3-chloro; 4-(N-ethylamino)-3-methyl; 4-(N,N-diethylamino)-2-methyl; 4-(N-ethyl,N-$\beta$-hydroxyethylamino); 4-pyrrodino-3-chloro; 4-pyrrodino-3,5-dichloro; 4-morpholino; 4-morpholino-3-chloro, 4-morpholino-2-methoxy; 4-morpholino-2,5-diethoxy; 4-morpholino-2,5-dibutoxy; 4-(4'-tolylmercapto)-2,5-dimethoxy; 4-(4'-tolylmercapto)-2,5-diethoxy; 4-(4'-methoxybenzoylamino)-2,5-dibutoxy; or 4-diphenylamino groups.

Benzenediazosulfonates which are preferable according to the present invention are those which facilitate the coupling reaction even if the pH is low. Examples of benzenesulfonates include 4-morpholino-2,5-dibutoxybenzene-diazosulfonate, 4-morpholino-2,5-diethoxybenzenediazosulfonate, 4-(4'-tolylmercapto)-2,5-diethoxybenzenediazosulfonate, 4-(4'-tolylmercapto)-2,5-dimethoxy-benzenediazosulfonate, N-ethyl,N-benzylaminobenzenediazosulfonate, 4-(4'-methoxy)-benzoylaminobenzenediazosulfonate, and so on.

A thermoplastic binder of any kind can be used unless it affects the pH of the heat-sensitive layer when it is formed. For example: Acrylic resins such as polymethacrylate ester and acrylate estermethacrylate ester copolymer; cellulose derivatives such as nitrocellulose, cellulose acetate, cellulose acetate-butyrate, ethylcellulose and hydroxyethylcellulose; vinyl acetate resins and their derivatives such as polyvinyl acetate, polyvinyl alcohol, polyvinyl formal, and polyvinyl butyral; and vinyl polymers of cyclic nitrogen compounds such a polyvinylpyrrolidone and polyvinylcarbazole; and polycarbonate resin. Most preferable are those having glass transition points between 70° C. and 150° C. Resins with glass transition points lower than 70° C. are not suitable for a heat-sensitive recording layer due to deposit of molten resin on the thermal head, though recording of high color intensity is possible by active molecular movement of the chromophore molecules during the heat-sensitive recording. Resins with glass transition points higher than 150° C., on the contrary, have drastically reduced color formation because the heat provided by the thermal head is not sufficient to induce adequate movement of the chromophore molecules. Accordingly, as the binder for a heat-sensitive recording device, use of a resin having a glass transition point between 70° C. and 150° C. is desirable.

Commercially available thermoplastic resins of comparatively high glass transition points are listed below with their glass transition points:

| | |
|---|---|
| Polymethylmethacrylate | 60–105° C. |
| Polyacrylate | 80–95° C. |
| Polycyclohexylacrylate | 66–88° C. |
| Polystyrene | 80–100° C. |
| Polydivinylbenzene | 106° C. |
| Polyvinyl alcohol | 68–85° C. |
| Polymethylchlororacrylate | 84–100° C. |
| Polyacrylonitrile | 80–100° C. |
| Polyethylene-1,5-naphthalate | 71° C. |
| Polyethylene-2,6-naphthalate | 113° C. |
| Triacetylcellulose | 30, 105° C. |

A photosensitive resin binder which cures by the irradiation of ultraviolet light preferably has a thermal softening initiating temperature of between 80° C. and 200° C. With a thermal softening initiating temperature of lower than 80° C., the temperature of the thermal head instantly reaches 200° C. to 350° C. causing blurred printing or imperfect printing of letters due to the adherence of the molten binder or the color former from the recording layer. It may also cause an interruption of printing by accumulation of work-up after a long duration of printing. With a thermal softening initiating temperature higher than 200° C., the movement of the chromophore molecules cannot be readily induced by the heat from the thermal head, resulting in reduced color formation. Some photocuring resins have thermal softening initiating temperatures exceeding 200° C. In such cases it is desirable to adjust the thermal softening initiating temperature by admixing with the photocuring resin an acrylic resin such as polymethacrylic ester, or a cellulose derivative such as nitrocellulose, or another thermoplastic resin in an amount up to, for example, 50% by weight (relative to the total weight).

Concrete examples of photocuring resins usable in the present invention are mentioned below.

The most important group belongs to cinnamic acid derivatives, typical of which are polyvinyl cinnamate, cinnamic esters of ethylene-vinylalcohol copolymer, cinnamic esters of Glyptal resin, cinnamic esters of epoxy resin, cinnamic esters of polyether, cinnamoyl type polymers with styrenic structure, cinnamoyl type acrylic polymers, cinnamic esters of styrene-maleic anhydride copolymer, polyvinylcinnamylidene acetate, polyvinylbenzylacetophenone and polyvinylstyrylketone.

The other group of photocuring resins, called azide type photopolymers, includes polyvinyl-p-azidobenzoate, polyvinyl-p-azidobenzal, polymers obtained by condensation of m-nitrobenzaldehyde and phenol, and polymers obtained by esterification of polyvinyl alcohol using p-azidocinnamic acid. Further, polymers having o-naphthoquinonediazide residues which belong to diazo-type photopolymers, or polymers having maleimide residues as photosensitive groups can also be used.

The photosensitivity of photosensitive resins can be improved by the use of a sensitizer, whereby photofixing can be conducted easily with a small amount of energy. Examples of useful sensitizers are: 5-nitroacenaphthene; N-acetyl-4-nitro-1-naphthylamine; p,p'-tetramethyldiaminobenzophenone; 9-fluorenone; p-nitroaniline; p-nitrodiphenyl; 2,4-dinitroaniline; 2-chloro-4-nitroaniline; 2,6-dichloro-4-nitoroaniline; anthraquinone; 1,2-benzanthraquinone; and picramide.

When the heat-sensitive and photosensitive layer of the recording material sticks to the thermal head of a thermal printer, problems arise such as imperfect printing of letters. To prevent such problems, incorporation of a lubricant and a mold-releasing agent in the heat-sensitive and photosensitive layer is recommended. In the case of dot-line type thermal printers wherein pressure is applied upon thermal printing, causing a high degree of friction between the recording material and the thermal head, the use of a lubricant and mold-releasing agent is particularly effective.

Useful lubricants agents are typically metal soaps, i.e. metal salts of aliphatic acids such as lauric or stearic acid. The following substances are also useful:

Organic tin salts aliphatic acids such as dibutyl-tin-dilaurate and dibutyl-tin-dinonylate;

aliphatic acid amides such as stearylamide, palmitylamide, oleylamide and bis aliphatic acid amide;

high ketones like stearone;

high alcohols and derivatives such as myristyl alcohol, cetyl alcohol, stearyl alcohol, polyethyleneglycol and polyglycerol;

hydrocarbons such as liquid paraffin, paraffin wax, microwax, low-molecular polyethylene; and natural waxes such as carnauba wax, candililla wax, beeswax, spermaceti wax, Chinese wax and montan wax.

The mold-releasing agents used in the present invention are those used generally in processing rubber and plastics for the purpose of improving the mold-releasing property. Various substances can be used as mold releasing agents, of which the main substances are:

Mineral oils such as petroleum ether;

vegetable oils such as olive oil and castor oil;

vaseline or lanolin;

aliphatic acids particularly alkanic or alkenic acids having 11 to 24 carbon atoms, and their esters, especially esters with alkyl or alkenyl groups having 6 to 24 carbon atoms;

phosphite esters, particularly with phenyl or alkyl groups (of 8 to 13 carbon atoms);

fatty acid esters of glycerin-sorbitan condensation products;

alkenoyl (of 7 to 21 carbon atoms) aminoacid esters; and fluorocarbons, Teflon, and silicones.

The recording material may be obtained by painting on a support body a heat-sensitive and photosensitive composition containing the above components.

For the raw material of the support body, an arbitrarily selected paper or film sheet may be used as long as it does not change the pH of the heat-sensitive layer. Characteristics which are preferable for the support body are evenness, heat-resistance, and impermeability to the sensitizer ink. Thus, it is preferable to use a surface-treated paper sheet such as a coated paper or an art paper, and it is effective to use a sealer. If a plastic film is desired, it is better to select a polyester or triacetate film which has relatively good heat-resistance.

The means for applying the heat-sensitive layer to this support layer are preferably the roll coating method or gravure coating method.

According to the present invention, a magnetic recording layer may be formed, in addition to the heat-sensitive layer, on the remaining portion or the opposite surface of the sheet-like support body on which the heat-sensitive layer is not formed, as needed.

The magnetic recording layer may be formed of a known magnetic paint. Such a magnetic paint mainly consists of a vehicle, a plasticizer, and a magnetic body. Preferable examples of the vehicle include a butyral resin, a vinyl chloride-vinyl acetate copolymer resin, an urethane resin, a polyester resin, a cellulose-type resin, an acrylic resin or the like. Examples of the plasticizer include mixtures of a rubber-type resin such as nitrile rubber with an elastomer such as an urethane elastomer. The magnetic body may be $\gamma$-$Fe_2O_3$; Co-containing $Fe_2O_4$, $Fe_3O_4$, barium ferrite ($BaO$-$6Fe_2O_3$); strontium ferrite ($SrO$-$6Fe_2O_3$); Co, Ni, Fe, Cr or alloys thereof; rare earth Co magnetic body; $CrO_2$, MnAl; and so on. In addition to these components, the magnetic paint may also include a solvent, a diluent, a surface active agent, a silane coupling agent, wax, silicone oil, carbon, pigments and so on as needed. The mixture is well milled by a three-roll mill, a sand mill, a ball mill or the like. In order to form the magnetic recording layer from such a magnetic paint, there may be adopted a known printing method such as offset printing, gravure printing, gravure offset printing, silk screen printing, relief printing, or the like; or a known coating method such as roll coating, gravure coating, knife coating, kiss coating or the like.

Alternatively, the magnetic paint as described above may be coated on a suitable flexible base body to prepare a magnetic recording tape. The base body of the obtained magnetic recording tape may then be adhered to the rear surface of the base body of the heat-sensitive recording material. Still alternatively, the magnetic paint as described above may be coated on a separable base body to form a magnetic layer. A heat-sensitive layer may then be coated on the magnetic layer to form a heat-sensitive adhesive layer to thereby form a magnetic transfer sheet. The obtained magnetic transfer sheet and the heat-sensitive recording material are superposed on each other so that the heat-sensitive adhesive layer of the magnetic transfer sheet faces the rear surface of the heat-sensitive recording material. The laminate body thus obtained is heated under pressure to transfer the magnetic layer.

Next, methods for fixing a heat-sensitive recording will be described.

When a thermoplastic resin is used as a binder, the method comprises irradiating light on a heat-sensitive layer containing a diazosulfonate, a coupling agent, and the thermoplastic resin binder so as to change the diazosulfonate unstable as represented by (2) and to effect an optical activation for improving the heat-sensitivity and photosensitivity; performing heat-sensitive recording on the activated heat-sensitive layer with a small amount of energy; and photofixing this with a relatively small exposure to light. The most important part of this method is that by supplying energy in the process of optical activation, the amount of energy required for heat-sensitive recording and photofixing to be performed thereafter may be made less. Thus, the use of a diazosulfonate sensitizer with a heat-sensitive printer has been made possible.

The light source to be used for optical activation must have a wavelength of over 400 nm and preferably up to 550 nm; it may be a xenon lamp, a tungsten lamp, a mercury lamp, an arc lamp, a halogen lamp, or a fluorescent lamp for copying. It is preferable to use a filter which cuts out light of over 550 nm in wavelength. The light source to be used for photofixing must have a wavelength of 300–450 nm and may be selected from the above-mentioned light sources.

The energy for optical activation is 0.1–10 $J/cm^2$ and preferably 4–6 $J/cm^2$, and the energy for photofixing is 1–20 $J/cm^2$, preferably 10–20 $J/cm^2$. Depending on the kind of diazosulfonate, the activating wavelength and fixing wavelength may not be different from each other. In such a case, the same light source may still be used, but the amount of irradiating energy is varied to perform the method of the present invention. For example, when the ratio of the energy for optical activation and for photofixing is 1:2, energy is supplied in the ratio of 5 $J/cm^2$: 10 $J/cm^2$.

The method of the present invention for fixing a heat-sensitive recording will now be described when a photocuring resin binder is used. Photocuring resins have relatively low thermal softening initiating temperature before irradiation of light which become very high by crosslinking, polymerization and so on. Due to this property, during heat-sensitive recording, the thermal reaction between the diazosulfonate and the coupling agent proceeds with good efficiency and, during photofixing, photocrosslinking and photopolymerization of the photocuring resin are effected as the photolysis of the diazosulfonate is effected, so that the heat-sensitive recording layer of the recording surface may be able to withstand abrasion and the influence of solvents.

Thus, by using a photocuring resin as the binder for the heat-sensitive recording layer, the recording characteristics, especially the color forming ability, are improved to the same degree or more than in the case f a thermoplastic resin, the strength of the recording layer after recording may be improved, and use over extended periods of time is satisfactory.

Further, as in the case in which a thermoplastic resin is used as described above, when a photocuring resin is used it is preferable to optically activate the resin with a light which will not cure the resin before heat-sensitive recording, althrough this is not absolutely necessary. Especially when the method is applied for use with a heat-sensitive printer, optical activation is advantageous since it is preferable that the energy required for heat-sensitive recording be less.

The wavelength and type of light source to be used for optical activation may be the same as in the case in which a thermoplastic resin is used. It must be noted that if the photocuring resin is cured at this stage, the heat-sensitive color forming ability is degraded. Thus, in order to obtain printing of higher density, special care must be taken with respect to the wavelength of the irradiating light.

The light source to be used for decomposing the diazosulfonate which has not undergone color formation must have a wavelength of 300–450 nm and may be selected from the above-mentioned types.

Ultraviolet light which cures photosensitive resins is below 400 nm in wavelength and may be irradiated from a light source selected from the above-mentioned types.

The two kinds of light for fixing as described above may be irradiated at the same time or separately. In the latter case, the order of irradiation may be arbitrarily selected.

Ultraviolet light (of a wavelength shorter than 400 nm) for curing the resin also has the ability to decompose the diazosulfonate, so that a single light source may be employed for photofixing and optical activation, and photodecomposition may be performed with the same wavelength and different energy levels. In summary, the light sources for optical activation and photofixing may be chosen depending on the characteristics of the diazosulfonate, the coupling agent and the photocuring resin used.

The energy for optical activation and the energy for photofixing may be the same as those in the case in which a thermoplastic resin is used as described above.

The thermal head used in the heat-sensitive recording of the present invention can be of any type including dot-type (line or matrix), segment type, and thermal-type or hot-pen type. The thermal energy necessary for the recording is from 0.4–10 W/1–3 msec per dot ($260\mu \times 130\mu$).

In the method of the present invention for fixing a heat-sensitive recording, since thermal recording is performed after raising the heat-sensitivity and photo sensitivity by optically activating the sensitizer as described hereinbefore, clear printing may be effected with a smaller amount of energy, and a stable and durable image may be obtained by a simple photofixing. Thus, the method provides a recording and fixing method suitable for the output devices of information processors, ticketing machines and so on which require printing at high speed.

The method in the present invention for fixing a heat-sensitive recording improves the print quality of printed media by enabling thermal printing with high pigment concentration and results in high durability of the recordings. Accordingly, it is suitable for recordings which may come in contact with water, oil or various other chemicals, and for documents such as commutation tickets and coupon tickets which are repeatedly used.

A device for fixing the information on a heat-sensitive recording sheet should be referred to the parent U.S. application Ser. No. 174,443.

EXAMPLE 1

| | |
|---|---|
| A. Diazosulfonate: | |
| Sodium benzenediazosulfonate having a 4-(4'-tolylmercapto)-2,5-diethoxy group | 3 g |
| Methyl cellosolve | 9 g |
| B. Coupling agent: | |
| 2-hydroxy-3-naphthoic acid | 2 g |
| Methyl cellosolve | |
| C. Thermoplastic resin binder: | |
| Polymethylmethacrylate (Sumipex B-MHO (trade name), glass transition point 115° C.) | 5 g |
| Methyl ethyl ketone | 67 g |

The solutions shown under items A–C were mixed immediately before coating. The compositions were painted by the roll coating method on a coated paper (Top coat manufactured by KANZAKI PAPER MFG. CO., LTD.) in the amount 50 g/m$^2$ (the coated amount of the diazosulfonate was 1 g/m$^2$). Drying was performed at a temperature of 60° C. for one minute.

Light from a xenon flashing lamp was irradiated in the amount of 5 J/cm$^2$ on the entire surface of a recording paper sheet thus obtained to optically activate it. Heat-sensitive recording was performed using a dot-type thermal head. The conditions were such that a voltage of 15 V was applied for a period of 50 msec. A clear blue image with no imperfect part was obtained.

Light from a diazocopying chemical lamp was then irradiated on the surface for 120 seconds to effect fixing, and areas other than the image were then whitened. Recording was impossible when the recording material was reheated, and thus the image was fixed.

After the recording paper sheet prepared in this example was left to stand at room temperature for 6 months, heat-sensitive recording was performed again in a similar manner. No degradation in coloration and fixability of printing was observed.

In order to measure the heat-sensitivity of the recording paper sheets obtained, after the recording paper sheets were optically activated, they were brought into contact with heated presses at temperatures of 80°, 100°, 110°, 130° and 150° C. under a load of 87.5 g/cm$^2$ for 5 seconds. Photofixing with the same light source as above was performed in a manner as described above with an irradiation of 15 J/cm$^2$. As a result, the coloration gradually started from a temperature of 100° C. and a coloration density of 1.0 (As measured through a filter of Kodak Wratten No. 106) was obtained at 130° C.

COMPARATIVE EXAMPLE 1

The composition was coated according to the same procedures as in Example 1 except that phloroglucinol was used in place of 2-hydroxy-3-naphthoic acid as the coupling agent. After leaving it to stand at room temperature for one week, heat-sensitive recording was performed. Although the coloration was satisfactory, fixability was significantly degraded. Brown fogging was noted, and the image contrast was poor.

COMPARATIVE EXAMPLE 2

A heat-sensitive recording paper sheet was obtained according to the same procedures as in Example 1 except that 2-hydroxy-3-naphthoic acid naphthylamide was used in place of 2-hydroxy-3-naphthoic acid as the coupling agent. The heat-sensitivity of the recording paper sheet thus obtained was measured as in Example 1. The coloration started from about 80° C., and a coloration density of 1.0 was obtained at 130° C. In this case, portions which was not contacted with a heating plate showed no fixing of the image, but fogging was gradually developed during storage.

COMPARATIVE EXAMPLE 3

A heat-sensitive recording paper sheet was prepared according to the same procedure as in Example 1 except that 2-hydroxy-3-naphthoic acid p-methoxyphenylamide was used in place of 2-hydroxy-3-naphthoic acid as the coupling agent. Heat-sensitive recording was performed as in Example 1. The non-image part was not fixed; this part was not optically decomposed and remained yellow.

COMPARATIVE EXAMPLE 4

A heat-sensitive recording paper sheet was prepared according to the same procedures as in Example 1 except that 2,3-dihydroxynaphthalene was used in place of 2-hydroxy-3-naphthoic acid as the coupling agent. The recording paper sheet was optically activated as in Example 1. Light blue coloration was observed over the entire surface. When thermal printing and photofixing were performed, both the image part and the non-image part were colored blue in the same degree, resulting in an unsatisfactory contrast.

EXAMPLE 2

| | | |
|---|---|---|
| A. | Sodium benzenediazosulfonate having a 4-benzoylamino-2,5-diethoxy group | 3 g |
| | Methyl cellosolve | 9 g |
| B. | 2-hydroxy-3-naphthoic acid | 2 g |
| | Methyl cellosolve | 6 g |
| C. | Sumipex B-MHO (trade name) (polymethylmethacrylate) | 5 g |
| | Methyl ethyl ketone | 57 g |

Optical activation was effected by a xenon flashing lamp (5 J/cm$^2$) in a similar manner as in Example 1, and a clear image was obtained when heat-sensitive recording was performed using a dot-line type thermal head. After fixing using a diazocopying chemical lamp, reformation of color was not observed when the recording material was exposed to the flame of a lighter.

EXAMPLE 3

| | | |
|---|---|---|
| A. | Sodium benzenediazosulfonate having a 4-(4'-tolylmercapto)-2,5-diethoxy group | 3 g |
| | Methyl cellosolve | 9 g |
| B. | 2-hydroxy-3-naphthoic acid | 2 g |
| | Methyl cellosolve | 8 g |
| C. | Sumipex B-MHO (trade name) | 5 g |
| | Methyl ethyl ketone | 57 g |
| D. | Polyethylene wax (AF wax (BASF, trade name), mp. 82–86° C.) | 1 g |
| | Toluene | 3 g |

The solutions shown under items A–D were mixed and were immediately painted by a roll coater onto a coated paper at the rate of 50 g/m$^2$ (the coated amount of the diazosulfonate was 1 g/m$^2$).

The recording paper sheet thus obtained was optically activated (5 J/cm$^2$) by irradiation by a xenon flashing lamp as in Example 1. Heat-sensitive recording was then performed using a thermal head of 7 segments type.

The printing conditions were such that a voltage of 15 V was applied for 50 msec. The blue image thus obtained was clear, and no imperfect part was noted. The image was made to pass under a diazocopying chemical lamp for 120 seconds, and the blue image alone remained to complete the fixing process.

EXAMPLE 4

| | | |
|---|---|---|
| A. | Benzenediazosulfonate having a 4-(N—ethyl-N—benzyl)amino group | 3 g |
| | Methyl cellosolve | 9 g |
| B. | 2-hydroxy-3-naphthoic acid | 2 g |
| | Methyl cellosolve | 8 g |
| C. | Sumipex B-MHO (trade name) | 5 g |
| | Methyl ethyl ketone | 67 g |
| D. | Polyethylene wax (AF wax) | 1 g |
| | Toluene | 3 g |

A recording paper sheet was prepared as in Example 4. After the recording material was optically activated by a xenon flashing lamp, heat-sensitive recording was performed using a dot-type thermal head as in Example 1. A blue image with no imperfect part was obtained. The fixing was performed by subjecting the image to a xenon flashing lamp three times (15 J/cm$^2$) until areas other than the image changed from yellow to white.

EXAMPLE 5

| | | |
|---|---|---|
| A. | Diazosulfonate: | |
| | Sodium benzenediazosulfonate having a 4-(4'-tolylmercapto)-2,5-diethoxy group | 3 g |
| | Methyl cellosolve | 9 g |
| B. | Coupling agent: | |
| | 2-hydroxy-3-naphthoic acid | 6 g |
| | Methyl cellosolve | 18 g |
| C. | Photosensitive resin: | |
| | Polyvinyl cinnamate (TPR-101, TOKYO OHKA KOGYO CO., LTD. trade name) | 4.5 g |
| | Methyl cellosolve | 14 g |
| D. | Lubricant: | |
| | Polyethylene wax (AF wax) | 1 g |
| | Toluene (dispersing medium) | 3 g |
| E. | Mold-releasing agent: | |
| | Fluorocarbon (Moldwiz F-57, manufactured by Axel Co., LTD.) | 0.1 g |
| | Toluene (dispersing medium) | 1 g |
| F. | Methyl ethyl ketone | 50 g |

The solutions shown under the items A–C above were mixed immediately before being painted by the roll coating method onto a coated paper (Top coat manufactured by KANZAKI PAPER MFG. CO., LTD.) in the amount of 50 g/m$^2$ (the coated amount of the diazosulfonate was 1 g/m$^2$). Drying was performed at a temperature of 60° C. for 20 seconds.

The entire surface of the recording material thus obtained was subjected to irradiation by a xenon flashing lamp (5 J/cm$^2$) for optical activation, and heat-sensitive recording was performed by a heat-sensitive printer. The thermal head used was of the dot-line type, and the applied energy was about 0.7 W/dot.

The entire surface of the recording material was then subjected to irradiation from a high voltage mercury lamp for two minutes for photofixing. That is, the diazosulfonate which has not undergone color formation was decomposed so as to whiten the areas other than the image, and the photosensitive resin was cured.

Durability tests were conducted with respect to resistance to alcohol, washability, and color fastness. The recording material was superior in every respect to the recording material using a thermoplastic resin.

EXAMPLE 6

| | | |
|---|---|---|
| A. | Sodium benzenediazolsulfonate having a 4-(N—ethyl-N—benzylamino) | 3 g |
| | Methyl cellosolve | 9 g |
| B. | 2-hydroxy-1-naphthoic acid | 6 g |
| | Methyl cellosolve | 18 g |
| C. | Azide polymer (A-101, Shinko Technical & Research Co., Ltd.) | 4.5 g |
| | Methyl cellosolve | 14 g |
| D. | Polyethylene wax (AF wax) | 1 g |
| | Toluene (dispersing medium) | 3 g |
| E. | Hostaflon TF9205 (Hoechst, trade name) | 0.1 g |
| | Toluene (dispersing medium) | 0.05 g |
| | Cellulose Acetate Butylate (CAB-381-05 Eastman Kodak, trade name) | 0.5 g |
| F. | Methyl ethyl ketone | 50 g |

A recording material having a heat-sensitive layer of the above composition was prepared as in Example 1.

A purplish red image of good quality was obtained by heat-sensitive recording. After undergoing photofixing by a high voltage mercury lamp, the recording material showed excellent chemical resistance and color fastness.

EXAMPLE 7

| | | |
|---|---|---|
| A. | Sodium benzenediazosulfonate having a 4-(4'-tolylmercapto)-2,5-diethoxy group | 3 g |
| | Methyl cellosolve | 9 g |
| B. | 2-hydroxy-3-naphthoic acid | 6 g |
| | Methyl cellosolve | 18 g |
| C. | Polyvinyl cinnamate | 4.5 g |
| | Methyl cellosolve | 14 g |
| D. | 5-nitroacenaphthene | 0.1 g |
| | Methyl ethyl ketone | 50 g |
| E. | Polyethylene wax AF | 1 g |
| | Toluene (dispersing medium) | 3 g |
| F. | Hostaflon TF9205 | 0.1 g |
| | Cellulose Acetate Butylate (CAB-381-05) | 0.05 g |
| | Toluene (dispersing medium) | 0.5 g |

The solutions shown under items A–F were each prepared and painted on a coated paper in a manner similar to Example 1. After drying, the recording material thus obtained underwent heat-sensitive recording, and a clear blue image was obtained.

This image showed improved durability upon photofixing and the resistance to alcohol and color fastness were excellent.

EXAMPLE 8

| | | |
|---|---|---|
| A. | Diazosulfonate: | |
| | Sodium benzenediazo-sulfonate having a 4-(4'-tolymercapto)-2,5-diethoxy group | 3 g |
| | Methyl cellosolve | 9 g |
| B. | Coupler: | |
| | 2-hydroxy-3-naphthoic acid | 4.5 g |
| | Methyl cellosolve | 13.5 g |
| C. | Thermoplastic binder: | |
| | Polymethyl-methacrylate (Sumipex B-BHO, manufactured by SUMITOMO CHEMICAL CO., LTD.) | 7.5 g |
| | Methyl ethyl ketone | 67.0 g |

The solutions shown under items A–C were mixed to prepare a photosensitive solution immediately before coating.

This photosensitive solution was coated on a polyester film of 188 μm thickness on which was coated, in advance, a primer of the composition shown below or which had a magnetic layer on the back surface. Drying was performed at about 80° C. for one minute. An OP (over-print) layer of the composition shown below and containing a lubricant and a mold-releasing agent was coated thereover. A paper sheet of a size for tickets obtained in this manner was printed by a ticket printer. The characters were printed blue, and the background was white. A ticket of good contrast was thus obtained.

| | |
|---|---|
| Primer composition: | |
| Polyester polyol (Biron 200, TOYOBO CO., LTD, trade name) | 20 parts |
| Vinyl chloride-vinyl acetate copolymer (VAGH, UCC, trade name) | 20 parts |
| Methyl ethyl ketone | 45 parts |

-continued

| | |
|---|---|
| Toluene | 90 parts |
| Isocyanate (Takenate-D-110N, Takeda Yakuhin Kogyo K.K., trade name) | 10 parts |
| Over-print layer composition (protective layer): | |
| Polymethylmethacrylate (700,000 in molecular weight) | 1 part |
| Polyethylene wax (AF wax BASF, m.p.; 82–86° C.) | 0.1 part |
| Mold-releasing agent: fluorocarbon (Moldwiz F-57, Axel Co., Ltd., trade name) | 0.5 part |
| Toluene | 20 parts |

EXAMPLE 9

A heat-sensitive recording paper sheet was prepared according to the same procedures as in Example 8 except that salicylic acid was used as the coupler. An image was formed in a similar manner to that in Example 8. Fixing was satisfactory, and an image of light yellow without fogging was obtained.

EXAMPLE 10

A heat-sensitive recording paper sheet was prepared according to the same procedures in Example 8 except that acetoacetoaminosalicylic acid was used as the coupler. An image was formed in a similar manner to that in Example 8. Yellow color at the non-image part disappeared after fixing, and a yellow image of good contrast and having no fogging was obtained.

EXAMPLE 11

A heat-sensitive recording paper sheet was prepared according to the same procedure as in Example 8 except that 3,4-dihydroxybenzoic acid was used as the coupler. An image was formed as in Example 8. Yellow color at the non-image part disappeared after fixing, and a brown image of good contrast and having no fogging was obtained.

EXAMPLE 12

A heat-sensitive recording paper sheet was prepared according to the same procedures as in Example 8 except that 4-bromo-α-resorcinoic acid was used as the coupler. An image was formed as in Example 8. Fixing was satisfactory, and a light brown image having no fogging was obtained.

EXAMPLE 13

A heat-sensitive recording paper sheet was prepared according to the same procedures as in Example 8 except that 4.0 g of 2-hydroxy-3-naphthoic acid and 1.0 g of acetoacetoanilide were used as the coupler. An image was formed as in Example 8. Fixing was satisfactory, and a green image having no fogging was obtained.

EXAMPLE 14

A heat-sensitive recording paper sheet was prepared according to the same procedures as in Example 8 except that 2.0 g of 2-hydroxy-3-naphthoic acid, 0.3 g of 2-hydroxy-1-naphthoic acid, 1.2 g of resorcinol, and 0.5 g of 4-bromo-α-resorcinoic acid were used as the coupler. An image was formed as in Example 8. Fixing was satisfactory, and a black image having no fogging was obtained.

What we claim is:

1. A heat-sensitive recording sheet adapted for use in a recording process consisting in sequence of optical activation with a wavelength of more than 400 nm, heat-sensitive recording with a thermal energy of 0.4–10 w/1–3 msec per dot (260μ×130μ) and photofixing at a wavelength of 300–450 nm, wherein on at least one major surface of a sheet-like support body is formed a heat-sensitive recording layer consisting of:

a diazosulfonate;

an acidic coupling agent comprising an aromatic compound in which one or more —OH groups and one —COOH group are bonded to an aromatic ring; and a member selected from the group consisting of thermosetting or thermoplastic resins having a glass transition point of 70°–150° C.

2. A heat-sensitive recording sheet according to claim 1, wherein the aromatic ring is a benzene ring or a naphthalene ring.

3. A heat-sensitive recording sheet according to claim 1, wherein said sheet-like support body is made of a plastic or a paper sheet.

4. A heat-sensitive recording sheet according to claim 1, wherein said sheet-like support body has a magnetic recording layer on the surface opposite the surface on which the heat-sensitive recording layer is formed.

5. A heat-sensitive recording sheet according to claim 1, wherein said heat-sensitive recording layer further consists of a lubricant.

6. A heat-sensitive recording sheet according to claim 1, 2, 3, 4 or 5, wherein said sheet-like support body is for preparing a transportation ticket.

* * * * *